United States Patent [19]

Houser

[11] 4,097,703

[45] Jun. 27, 1978

[54] TRIGGER SWITCH AND LOCK MECHANISM THEREFORE

[75] Inventor: John Martin Houser, Pickens, S.C.

[73] Assignee: The Singer Company, New York, N.Y.

[21] Appl. No.: 822,166

[22] Filed: Aug. 5, 1977

[51] Int. Cl.[2] ..... H01H 9/06

[52] U.S. Cl. ..... 200/157; 200/44; 200/164 R; 200/321; 200/328; 310/50

[58] Field of Search ..... 200/16 R, 16 A, 16 B, 200/16 C, 16 D, 42 R, 42 T, 44, 50 R, 80 R, 164 R, 321, 328; 318/345 R; 310/50, 68 R, 246

[56] References Cited

U.S. PATENT DOCUMENTS

| | | | |
|---|---|---|---|
| 2,481,499 | 9/1949 | Collura | 310/246 |
| 2,525,839 | 10/1950 | Sparklin | 310/50 |
| 3,328,613 | 6/1967 | Gawrow | 200/157 |
| 3,549,844 | 12/1970 | Chambers | 200/157 |
| 3,588,411 | 6/1971 | Milkey | 200/157 |
| 3,594,523 | 7/1971 | Frenzel | 200/164 A |
| 3,626,118 | 12/1971 | Rotefuhr | 200/157 |
| 3,648,142 | 3/1972 | Corey | 310/50 |
| 3,660,742 | 5/1972 | Gawron | 318/345 R |
| 3,703,646 | 11/1972 | Jacyno | 200/157 |
| 3,869,591 | 3/1975 | Piber | 200/157 |

*Primary Examiner*—Ro E. Hart

*Attorney, Agent, or Firm*—Harold Weinstein; Edward L. Bell; Robert E. Smith

[57] ABSTRACT

A trigger switch and lock mechanism therefore to be mounted in the handle of a drill housing for activating a motor of a drill wherein the trigger switch includes a speed control circuit carried on a circuit board. A trigger is slidably disposed in mounting brackets affixed on the circuit board. A locking member is slidably connected in one of the mounting brackets and is shiftable into contact with the trigger so as to lock the trigger in depressed position so that once the switch has been activated it will be locked in the "on" position at the selected speed setting. A spring is connected to the locking member to release the locking member from engagement with the trigger upon subsequent trigger depression to place the switch in the "off" position.

The locking member and trigger have correspondingly high friction contact surfaces.

The locking member may have a camming portion which coacts with the bracket to cause a wedge-lock action at the trigger contact surface which is releasable only upon subsequent trigger depression resulting in release of the locking member and deactivation switch upon the trigger load spring biasing the trigger to the "off" position.

17 Claims, 9 Drawing Figures

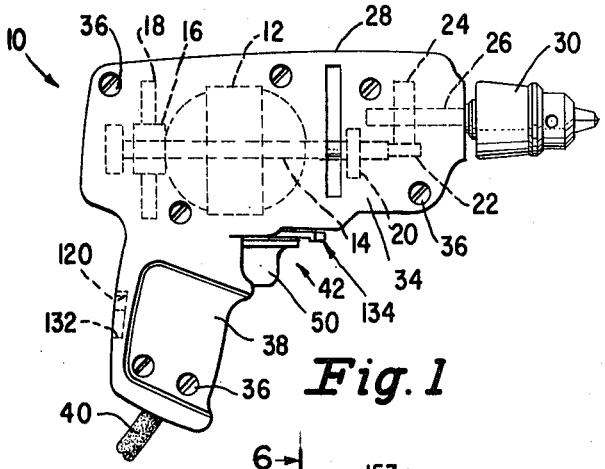
Fig. 1
Fig. 5
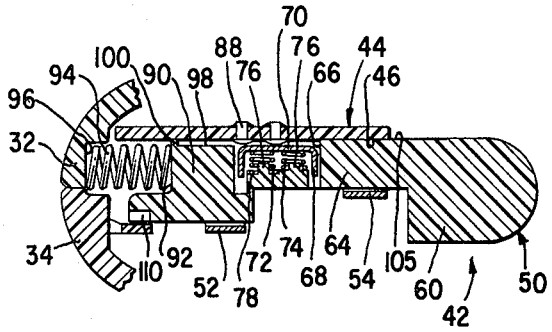
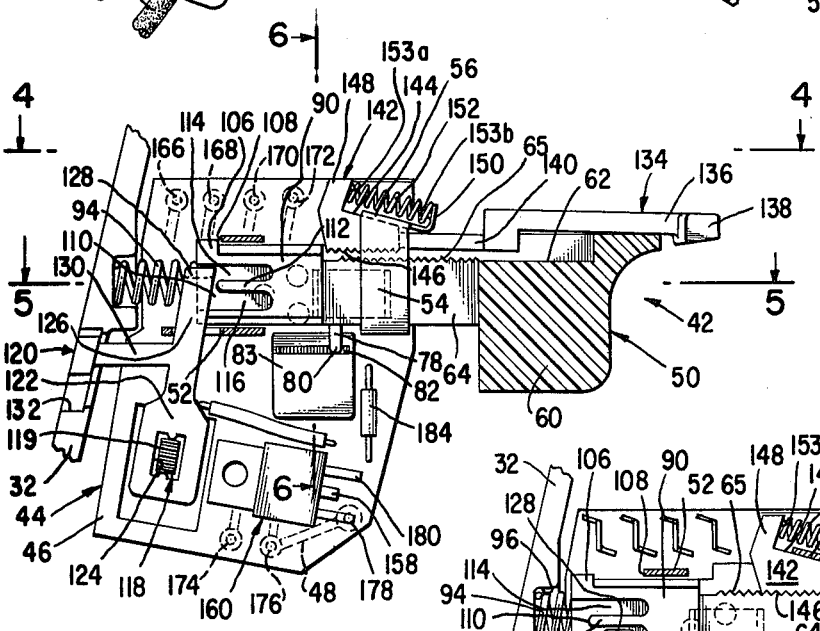
Fig. 2
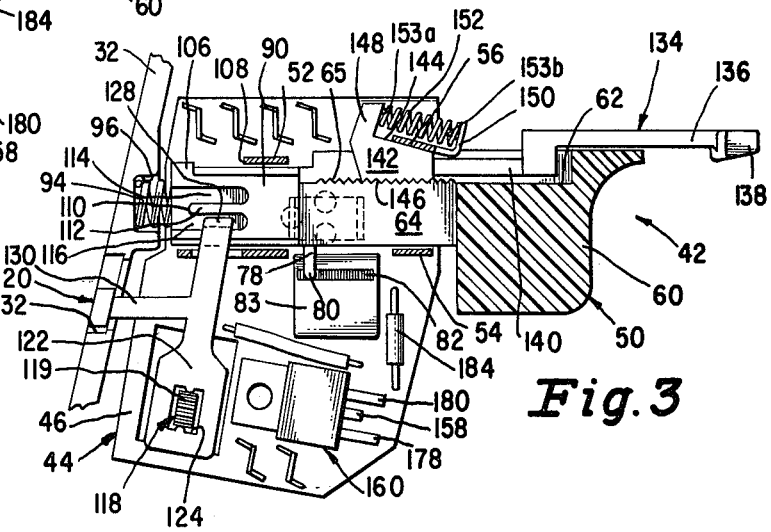
Fig. 3
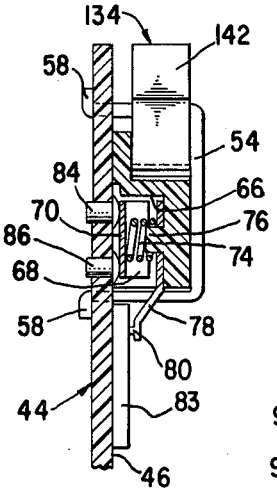
Fig. 6
Fig. 4
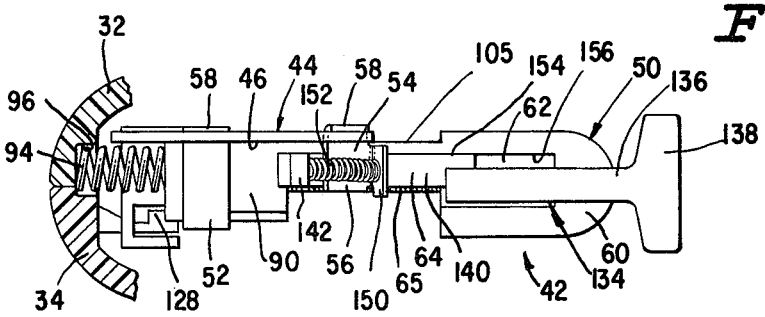

TRIGGER SWITCH AND LOCK MECHANISM THEREFORE

BACKGROUND OF THE INVENTION

Trigger switches for power tools, such as drills, are available in plastic cases, which switches may be simply the on-off type or the speed control type with speed variably responsive to the amount of trigger depression. A side lock button is usually provided for locking the switch in either the "on" position or at a predetermined speed. Reversing the motor direction also is possible through the use of a reversal switch which may be included as part of the trigger switch package. The trigger switches housed in small plastic cases are susceptible to overheating, and because visual inspection of the case is not possible improper assembly is never detectable by simple visual inspection. Even when a switch malfunctions, disassembly is impractical. The use of a side mounted lock button presents particular difficulty for left handed operators in that it is possible in grasping the handle with the left hand to inadvertently engage the lock button. Also, the flexibility in locking the switch at a predetermined speed is very limited and resort has been made to the use of some form of settable dial mechanism which has the added disadvantages of complex structure and difficulty of repeatability at a desired speed. Attempts at switches constructed in the handle without separate cases have met with only limited success, while still presenting the disadvantages present in the lock button mechanism, and assembly is slower.

SUMMARY OF THE INVENTION

It is therefore an object of the present invention to provide an improved trigger switch and lock therefore which overcomes the prior art disadvantages; which is simple and economical to assemble, and reliable; which is capable of visual inspection; which is releasably lockable in the "on" position; which for a speed control switch is selectively lockable in any one of an infinite number of variable speed control settings; which includes an interlocked reversing switch; which uses a front actuated locking member; which locking member includes a cam shoe capable of being wedge locked between a bracket and the trigger; which locking member is releasable on slight trigger depression; which locking member is spring biased in the unlocked position; which uses a coacting tapered bracket and tapered cam shoe; which uses a speed control circuit carried on a printed circuit (PC) board having the electrical components connected thereto; which PC board includes the camming bracket; which PC board is uncased and defines a subassembly of the trigger switch; and, which locking member and trigger have complimentary high friction contact surfaces; and, which trigger switch and lock therefore are assembled on the PC board to be mounted as a subassembly in a clam shell handle.

Other objects and advantages will be apparent from the following description of several embodiments of the invention and the novel features will be particularly pointed out hereinafter in the claims.

BRIEF DESCRIPTION OF THE DRAWINGS

This invention is illustrated in the accompanying drawings in which:

FIG. 1 is a side elevational view of a power tool, preferably a drill, embodying the present invention.

FIG. 2 is a side elevational view, partly in section, of the trigger switch mounted in the handle with only the rear portion thereof shown, with the switch in the "off" position, the locking member disengaged and the reversing switch interlocked in the forward position.

FIG. 3 is a side elevational view, partly in section, showing the trigger switch of FIG. 2 in the "on" position, the locking member engaged and the reversing switch interlocked in the reverse position.

FIG. 4 is a top plan view taken along lines 4—4 of FIG. 2.

FIG. 5 is a top plan view taken along lines 5—5 of FIG. 2.

FIG. 6 is an elevational view taken along lines 6—6 of FIG. 2.

DESCRIPTION OF THE INVENTION

Figure 9:
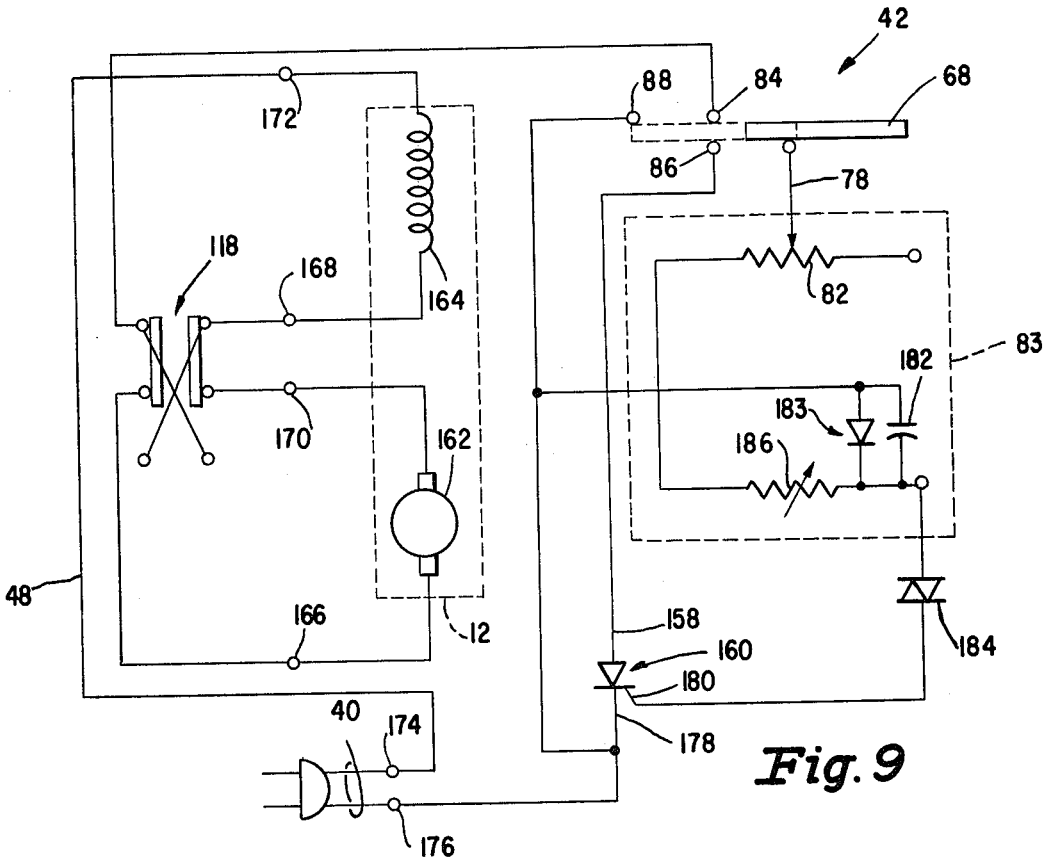
FIG. 9 is a schematic circuit diagram of the improved trigger switch.

A power tool, such as a portable power drill 10 is shown in FIG. 1 embodying the present invention. The drill 10 includes an electric motor 12 having an armature shaft 14 which carries a commutator 16 engaged by a brush assembly 18. The armature shaft 14 is journaled in a pair of spaced bearings 20, and has a drive pinion 22 formed at its forward end. The pinion drives a gear train 24 and a driven spindle 26 the front of which exits the drill housing 28 to be threadedly connected to a chuck 30 which is adapted to drive a suitable bit or implement (not shown) that comes into engagement with the work. The motor 12 is journaled in the housing 28 as shown in FIG. 1 which is preferably of a clam shell construction as indicated in FIGS. 4 and 5 wherein a support portion 32 and a cover portion 34 are suitably connected to each other as by screw means 36 illustrated in FIG. 1 extending through the cover portion 34 of the housing 28 to be threadedly connected to the support portion or separate nut means (not shown) to form what is commonly termed a clam shell housing. The housing 28 has an integrally formed pistol grip handle 38 which receives an electric cord 40 depicted in FIGS. 1 and 9 that in turn is connected through a trigger switch 42 which is in circuit with the motor 12 as will be described more fully hereinafter under the schematic circuit diagram of FIG. 9.

In assembling the drill 10, the cover portion 34 will be removed from the support portion 32 of the housing 28 to permit easy access and visibility of all the drill components particularly those included in the trigger switch 42.

In the preferred embodiment of the invention illustrated in FIG. 2 the improved trigger switch 42 has a printed circuit (PC) board 44 the face side 46 of which carries the discrete devices which are suitably electrically connected through the PC board 44 to the opposite side of the PC board 44, and in circuit with various PC conductor paths 48 some of which are shown by the dotted line representation. The PC board 44 is disposed to be connected in the handle 38 either by being entrapped between the handle halves 32 and 34 or by means of suitable bent tabs or screw fasteners or the like.

A trigger 50 is slidably affixed to the PC board 44 by a rear mounting strap or bracket 52 and a front mounting strap or camming bracket 54, the top 56 of which is tapered to extend forwardly and downwardly for purposes which will be explained more fully hereinafter. Each of the brackets 52 and 54 are connected to the PC board 44 by staking as illustrated in FIGS. 4 and 6 at stake points 58, 58.

The trigger 50 has a front portion 60 which projects from an opening in the handle as shown in FIG. 1 and is gently curved for comfortable engagement by the operator's finger. The trigger 50 will be longitudinally depressed into the handle 38 by the operator. A recess 62, shown in FIGS. 2, 3 and 4, is formed in the top of the forward portion 60, the base of which extends into the mid-portion 64 and serves as the top surface 65 thereof. The top 65 is serrated substantially along its entire length to form a high friction contact surface. A cavity 66 is formed in the mid-portion 64 on the side adjacent the PC board 44 to receive a substantially "U" shaped switch contact wiper 68 shown in FIGS. 2, 5 and 6 as having a substantially flat base 70 which is loaded to the PC board 44 by two springs 72 and 74 disposed on round bosses 76, 76 formed in the side wall of cavity 66. The down turned legs of the wiper 68 serve to entrap the wiper 68 within the cavity 66. A resistance wiper 78 is disposed on the left most boss 76 and held in position by the spring 72 as illustrated in FIGS. 5 and 6. A contact finger 80 is formed integrally with the wiper 78 and extends downwardly from the open bottom of the cavity 66 to slidably engage a resistance strip 82 of the resistance-capacitance module 83 as shown in FIGS. 2, 3 and 6. Contact rivets 84, 86 and 88 are connected to the PC board 44 in the path of travel of the contact wiper 68 and positioned so that upon trigger 50 depression into the handle 38, the wiper 68 will first engage the contacts 84 and 86 and after predetermined further depression of the trigger contact will be made with the rivet contact 88 for purposes more fully explained hereinafter. A rear portion 90 extends from the mid portion 64, with the rear face having a setback 92 formed on the PC board 44 side to receive a trigger load spring 94 the other end of which seats within a handle recess 96. The side face of the rear portion 90 facing the PC board 44 has a shallow recess 98, best seen in FIG. 5, which communicates with the cavity 66 and is sized to permit that portion of the trigger 50 to travel past, without interfering with, the contact rivets 84, 86 and 88. This is so because a boss 100 is formed at the rearward end of the recess 98 to slidingly engage the face 46 of the PC board 44 to the left of the contact rivet 88. A side 105 provides continuity for portions 60, 64 and 90 of the trigger 50, extends adjacent to the PC board 44 and contains the cavity 66 and recess 98 therein. The trigger 50 has a different width for each portion, with the front portion 60 having the largest dimension and the mid-portion 64 having the smallest dimension. The brackets 52 and 54 are sized corresponding to the adjacent portion of the trigger 50 to be accommodated so that once assembled to the PC board 44 the trigger 50 will not be accidently dislodged. The rear portion 90 of the trigger 50 has a vertically extending projection 106 formed at its rear face side as shown in FIGS. 2 and 3 which acts as a forward stop to engage the top rear edge 108 of the rear bracket 52 as shown best in FIG. 2 to prevent excessive forward motion of the trigger 50. An opening 110 shown in FIGS. 2, 3 and 5 is formed at the rear of the face side of the rear trigger portion 90 and leads into parallel horizontal slots, separated by a horizontal rib 112, with the upper slot 114 being designated for forward motor rotation, and the lower slot 116 being designated for reverse motor rotation, which slots are depicted in FIGS. 2 and 3.

A reversing switch 118 is affixed to the PC board 44 in circuit therein. The reversing switch 118 is a double pole-double throw (DPDT) type and it has a slide button 119 used to position it in either forward or reverse. An actuator 120 having a body portion 122 with a central aperture 124 which is disposed about and in engagement with the slide button 119 of the reversing switch 118 so that movement of the actuator 120 will place the reversing switch in an upward position for forward motion of the motor 12 or in a downward position for reverse motion of the motor 12. An interlock arm 126 extends upwardly from the body 122 to terminate in an inwardly facing flange 128 shown in FIGS. 2, 3, 4 and 5, which is sized to be slidingly disposed in the opening 110 to be shifted between slots 114 or 116 of the trigger 50. An actuator arm 130 extends rearwardly, as shown in FIGS. 2 and 3, from the interlock arm 126 to reside within an elongated slot 132 formed in the rear end of the handle 38 for sliding movement therein. The operator will position the actuator arm 130 in one of two positions, with the upper position shown in FIG. 2 for forward motion of the motor 12 whereby the flange 128 will be received in the forward slot 114 of trigger 50, and the lower position shown in FIG. 3 for reverse motion of the motor 12 whereby the flange 128 was moved downwardly to be received in the reverse slot 116. The rib 112 acts to prevent operation of the reversing switch 118 during operation of the motor upon depression of the trigger 50. Therefore, once the trigger 50 has been depressed the flange 128 will engage the rib 112 to prevent the reversible operation of switch 118. Thus the actuator 120 can only change the position of switch 118 when the flange 128 resides in the opening 110, corresponding to the trigger switch off position shown in FIG. 2.

A locking or lock-release member 134 is illustrated in FIGS. 2, 3, 4 and 6, and has a forwardly extending external lever 136 which terminates in a "T" shaped handle 138 which extends on either side of the trigger 50 as shown in FIG. 4. The lever 136 extends externally of the housing 38 immediately above and forwardly of the trigger 50 for convenient operator manipulation as more fully described hereinafter. The lever 136 is stepped down at its inner end for an offset connection to a midsection 140 shown in FIGS. 2 and 4 which extends rearwardly to terminate in a cam shoe 142 the upper surface 144 of which is tapered corresponding to the tapered top 56 of the camming bracket 54. The lower surface 146 of the shoe 142 lies horizontally below the lower surface of the midsection 140 and is serrated to define a high friction contact surface. A spring retainer 148 projects upwardly from the rear of the cam shoe 142 at the rearward end of the tapered surface 144. A bracket extension 150 in the form of an upwardly turned flange extends from the lower portion of the tapered top 56 to face the retainer 148. A spring 152 is disposed between the retainer 148 and the extension 150 to normally urge the locking member 134 in its rearmost position within the handle 38 as shown in FIG. 2. The spring 152 is held in position by pegs **153*a* and 153*b*** formed on the retainer 148 and extension 150, respectively. The cam shoe 142 of the locking member 134 is entrapped within the bracket 54 and the tapered surface 144 is in continual contact with the tapered top 56 of the bracket. With the cam shoe 142 in the rearmost position the lower surface 146 will remain out of contact with the upper serrated surface 65 of the trigger 50. The midsection 140 of the locking member 134 being disposed in the recess 62 of the trigger 50 wherein the inner side 154 slidingly engages the side 156 of the recess 62 to guide the motion of the locking member 134 and limit it to the linear direction. The spring 152 will load the locking member 134 toward an unlocked position because the bracket extension 150 has a fixed position while the spring retainer 148 is movable along with the locking member 134. When the trigger 50 is in the unlocked position shown in FIG. 2, it can be moved freely through its entire depressed movement wherein it will compress the trigger load spring 94 so that upon release the spring 94 will force the trigger to return to its normally "off" position. Though the present invention is useable with a simple "on-off" switch, it has been embodied in the trigger switch 42 which includes speed control capabilities so as to more completely describe the advantageous results of the present invention. The extent of trigger 50 depression will determine the speed at which the drill motor 12 operates with the speed increasing as the trigger depression increases with the maximum depression of the trigger 50 being shown in FIG. 3.

To lock the trigger 50 at any desired speed setting of the trigger switch 42, the trigger 50 will be retracted to obtain the desired speed, which in the present instance is assumed to be the maximum speed corresponding to the setting illustrated in FIG. 3, and held in that position while the locking member 134 is pushed forwardly. Forward movement of the locking member 134 causes the tapered surface 144 of the cam shoe 142 to slide forwardly and downwardly under the urging of the tapered top 56 of the camming bracket 54 until the cam shoe 142 becomes wedged-locked under the angled tapered top 56 of the camming bracket 54, thus forcing the lower surface 146 to seat its serrations into those formed on the top surface 65 of the trigger 50. The trigger load spring 94 exerts a forward pressure on the trigger 50 to maintain a sufficient force on the locking member 134 to keep the contact surfaces 65 and 146, respectively, engaged with each other, and the cam shoe 142 wedged under the camming bracket 54 prevents any further forward movement of the trigger 50, and therefore, any change of speed from the maximum illustrated in FIG. 3.

To release the locking member 134, the trigger 50 is pulled rearwardly to physically shift the cam shoe 142 rearwardly out from under the angled face or tapered surface 56 of the camming bracket 54 so as to initiate a disengagement of the serrated surfaces 65 and 146 whereby the spring 152 will continue to push the locking member 134 rearwardly to cause the tapered surface 144 to ride upwardly along the tapered top 56 and away from the serrated top surface 65, thus freeing the trigger 50 and permitting its release. Once the wedge-lock of the locking member 134 has been broken and the serrated surfaces 65 and 146 separated the spring 94 has no influence on the locking member 134. The length of the serrated top surface 65 of the trigger 50 is substantially twice the length of the lower serrated surface 146 of the cam shoe 142. This permits the trigger 50 to be locked in any desired speed setting from "off" to the maximum speed in the "on" setting.

The switch contact wiper 68 illustrated in FIGS. 2, 5 and 6 is loaded to the PC board 44 by the contact springs 72 and 74. The wiper 68 is entrapped in the trigger cavity 66 and will slide with the trigger 50. As the trigger 50 is pulled rearwardly, the wiper 68 first bridges the rivet contacts 84 and 86 shown in FIGS. 2 and 6, and in the schematic circuit diagram of FIG. 9. The various printed circuit conductor paths are designated generally 48, and are formed on the underside of the PC board 44 as illustrated in FIG. 2, and these conductor paths are shown in circuit in the schematic of FIG. 9, in which the lines or conductor paths will still be referred to by the general designation 48, but the electrical devices or components interconnected by the lines 48 will be specifically identified. Also, for a better understanding of the explanation of the electrical operation of the improved trigger switch 42 reference may be had to FIGS. 2 and 9.

Contact 86 is connected to the anode 158 of the silicon control rectifier (SCR) 160 via one of the PC conductor paths 48. Likewise contact 84 is connected to the reversing switch 118, the motor 12 to be controlled as indicated by the armature 162 and the field 164 disposed within the dotted lines for the motor 12 of FIG. 9, and one side of the line voltage cord 40 via a PC conductor path 48 and a jumper wire or path also formed on PC board 44, and quick disconnect terminals 166, 168, 170, 172, 174 and 176. Terminals 166, 168, 170 and 172 serve as output terminals, while terminals 174 and 176 serve as line cord terminals. Contact 84 connects to the line voltage terminals 174, while the cathode 178 of the SCR 160 is connected to the other line voltage terminal 176, and therefore, bridging the contacts 84 and 86 will start the motor 12.

With the SCR 160 in series with the motor 12, the speed can be varied by the point into every other half cycle of line voltage (when the SCR 160 anode to cathode voltage is positive) at which SCR 160 is triggered into conduction via the gate 180 of the SCR 160. The gate 180 trigger point is determined by the position of the resistance wiper 78 on the primary resistance strip 82 of the RC module 83. The wiper 78 is carried on the boss 76 of trigger 50 and is connected to line voltage through the spring 72 and wiper 68 to the contact 84. As the trigger 50 moves rearwardly the wiper 78 decreases the effective resistance on the module 83 and causes the capacitor 182 of the module 83 to charge faster. A trigger diode (diac) 184 breaks down sooner dumping the capacitor 182 charge into the gate 180 of the SCR 160 and therefore turns the SCR 160 on sooner. When the SCR 160 turns on sooner in each half cycle, the effective voltage of the motor 12 is higher and, therefore the motor 12 speed is correspondingly higher. Diode 183 is connected in parallel with capacitor 182 so as to prevent 182 from charging when the anode to cathode voltage of SCR 160 is negative. This starts the voltage on capacitor 182 near zero at the start of each positive half cycle of line voltage and helps stabilize the trigger point. Further, since capacitor 182 cannot charge negative causing trigger diode 184 to break down and dumping the negative capacitor charge into gate 180 of SCR 160, no false triggering or gate-cathode junction damage of SCR 160 can occur during a negative half cycle of line voltage. As the trigger 50 moves rearwardly toward the end of its stroke, wiper 68 connects rivet contact 88 via a PC path 48 to the terminal 176 which shunts, or bypasses, the anode 158 and cathode 178 of the SCR 160. This connects the motor 12 to full A.C. line voltage and places the motor 12 into high speed operation. Of course, as the trigger 50 is released from the full "on" position, the above described operations are reversed in order of occurrence and the motor 12 speed decreases to zero at the full "off" position.

The reversing switch 118 is a DPDT PC switch which, when actuated, reverses the armature 162 terminals of the motor 12 relative to the field 164 which always remains connected in the same direction relative to the line voltage terminals 174 and 176. The armature 162 is connected to the common center terminals 166 and 170 and suitable PC conductor paths 48. A crossing pattern consisting of a PC conductor path 48 and a jumper wire or path 48 located on the underside of the body of the switch 118 connects the outside switching terminals of the switch and allows reversing to take place. It should be noted that the connected positions of the armature 162 and the field 164 can be interchanged, reversing the field relative to the armature with no change in performance and achieving proper motor reversal.

The RC module 83 contains a secondary resistor 186 in series with the main variable resistor 82. By trimming the secondary resistance 186 the initial speed of the motor, when it is first turned on, can be adjusted for the desired slow or "creep speed". Trimming can be accomplished with a laser or other suitable means of increasing the resistance by removing material from the secondary resistor 186.

Figure 7:
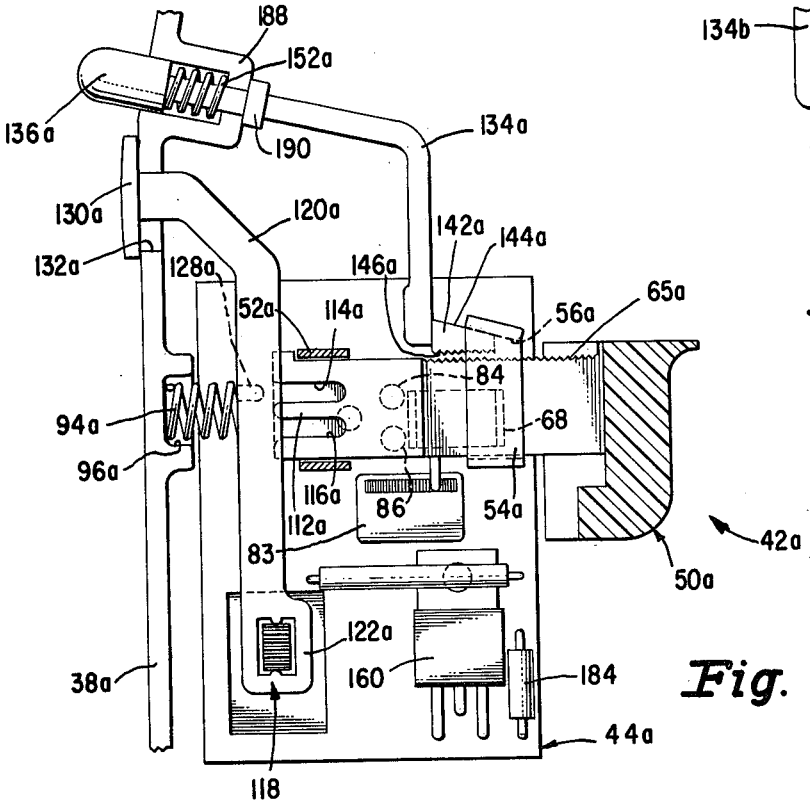
FIG. 7 is a side elevational view, partly in section, showing another embodiment of the improved trigger switch wherein the locking lever and the reversing switch are activated from the rear of the handle, only a portion of which is shown.

In the embodiment of the invention illustrated in FIG. 7 like reference characters have been used for like components shown and described hereinbefore under the embodiment of the invention illustrated in FIG. 2. In some instances a component will function in a similar manner but may have been structurally modified and therefore will carry a suffix "*a*" at the end of the reference character. The electrical circuit associated with the trigger switch **42*a* depicted in FIG. 7 will be substantially the same as that illustrated in the schematic circuit diagram of FIG. 9**.

A PC board **44*a* is suitably mounted in a handle 38*a* of a power tool such as a drill similar to that shown in FIG. 1. The PC board 44*a* has the discrete devices such as the RC module 83, reversing switch 118, SCR 160 and diac 184** mounted on the face side thereof to extend through and be connected in circuit with suitable PC conductor paths (not shown).

The trigger **50*a* is slidably mounted to the PC board 44*a* and held in assembled position by a rear mounting bracket 52*a* and a front camming bracket 54*a*, through which brackets 52*a* and 54*a* the trigger 50*a*** slides in its movement.

A trigger load spring **94*a* is held captive within a recess 96*a* of the handle 38*a* and the rear of the trigger 50*a* to urge the trigger to remain in the "off" switch position. Rearward pressure by the operator on the trigger 50*a* will compress the spring 94*a* during operation so that the spring 94*a* will restore the trigger 50*a* in the extended "off" position when released. When the trigger 50*a* is retracted sufficiently to place the wiper 68 in contact with contact rivets 84 and 86, the trigger switch 42*a*** will be in the "on" position causing the motor of the power tool to operate.

A reversing switch actuator **120*a* has an integrally formed inwardly facing flange 128*a* which will be placed in alignment for sliding engagement in a forward slot 114*a* or a reverse slot 116*a* so as to prevent reversing the output direction of the motor while the tool is on. The actuator has a body 122*a* which fits securely over the reversing switch to change its position from forward to reverse or back again, with the forward position corresponding to the raised position shown in FIG. 7 and the reverse position corresponding to the lower position. Once the interlock flange 128*a* has entered either of the slots 114*a* or 116*a* a rib 112*a* will prevent actuation of switch 118 during the period of time the switch 50*a* remains depressed. The actuator 120*a* has a control button 130*a* which exits the handle 38*a* at slot 132*a*** for convenient operator actuation.

The locking member **134*a* has a rearwardly exiting lever 136*a* which is spring loaded by a lock release spring 152*a* entrapped in a counterbore handle boss 188, which spring 152*a* urges the locking member 134*a* to remain in the released position. A lever stop 190 is affixed to the locking member 134*a* to limit the retracted position. With the locking member 134*a* in the retracted position the trigger 50*a* is free to move through its entire range of on-off movement. To lock the trigger switch 42*a* at any desired speed the trigger 50*a* will be retracted to obtain the desired speed, held in that position while the lever 136*a* is depressed or pushed forward to also cause the locking member 134*a* to be shifted forwardly. Forward movement of the locking member 134*a* will cause the tapered top surface 144*a* to slide forwardly and downwardly along the top tapered surface 56*a* of the camming bracket 54*a* to produce a wedge-lock action between its lower serrated surface 146*a* and the serrated top surface 65*a* of the trigger 50*a*. The angle face of the camming bracket 54*a* forces the respective serrations of the surfaces 146*a* and 65*a* to be securely interlocked so long as the cam shoe 142*a* remains wedged between the trigger 50*a* and the bracket 54*a*. Since the force of the spring 94*a* which urges the trigger in the forward direction so as to retain the wedge-lock is substantially larger than the force of the release spring 152*a*, also the wedge shaped components and the high friction engagement all aid in keeping the trigger 50*a*** in locked position.

To release the locking member **134*a* the trigger 50*a* is pulled rearwardly forcing the camming shoe 142*a* rearwardly and away from under the angle face of the camming bracket 54*a* a sufficient distance to separate the serration and permit the locking member 134*a* to be solely under the influence of the release spring 152*a*. This pushes the cam shoe 142*a* rearwardly along the tapered surface 56*a* so that the trigger 50*a* once released from the locking member 134*a* will be pushed forwardly under the influence of the trigger load spring 94*a*** to its normally "off" position.

Figure 8:
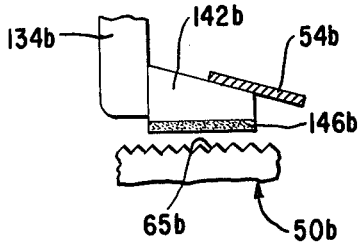
FIG. 8 is a partial side elevational view of the camming member of the locking member of FIG. 7 disengaged from the contact surface of the trigger wherein dissimilar high friction materials are used.

In each of the embodiments of the present invention serrated contact surfaces have been used to produce a high friction engagement between the respective locking member and the trigger. The high friction contact surface may take any one of a number of forms with serrations being only one of the many possibilities. An alternate form is illustrated in FIG. 8 wherein the locking member **134*b* has a cam shoe 142*b* in sliding engagement with a camming member 54*b* and disposed in superposition to the serrated top surface 65*b* of a trigger 50*b*. In this instance the lower surface 146*b* is formed of a resilient plastic or rubber material which yieldably engages the serrated surface 65*b* to produce the necessary wedge-lock engagement therewith and is also a high friction contact surface so as not to slip loose from the locked position. Release of the trigger 50b will be as described hereinbefore wherein slight depression of the trigger 50b will loosen the wedge-lock action of the locking member 134b** which being shifted rearwardly will cause the disengagement between the contact surfaces.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention what is claimed herein is:

1. A releaseable lock mechanism for a trigger-switch mounted in the handle of a drill housing for activating a motor of a drill, said mechanism selectively to lock the trigger-switch in the activated condition comprising:

(a) a trigger of the trigger-switch slidably connected in the handle and normally biased with the switch off and extending outwardly of the handle, and being depressed to activate the switch, (b) a camming member affixed in the handle in spaced relation to the trigger, (c) a locking member shiftably disposed in the handle, and having a lever extending outwardly of the handle and a cam shoe engaging the camming member, (d) the lever being moved relative the handle to cam the cam shoe against the camming member causing it to shift into a wedge lock against the trigger, and (e) a resilient means in the housing normally to urge the locking member out of engagement with the trigger and to cause release of the wedge-lock upon slight depression of the trigger resulting in release of the trigger and deactivation of the switch.

2. The combination claimed in claim 1 wherein:

(a) the camming member defines a tapered bracket disposed in spaced relation to the trigger, and (b) the cam shoe has a tapered surface with a slope corresponding to that of the tapered bracket adjacent thereto to permit relative sliding motion between the bracket and the shoe upon shifting of the lever.

3. The combination claimed in claim 2 wherein:

(a) the trigger partakes of straight line motion into and out of the handle to activate or deactivate the switch, (b) the locking member disposed in super position to and independently of the trigger, (c) the tapered bracket being tapered downwardly in the direction of the normal outward bias of the trigger, and (d) the tapered surface of the cam shoe having a slope corresponding to that of the tapered bracket.

4. The combination claimed in claim 3 wherein:

(a) the trigger has a flat locking contact surface, and (b) the locking member has a flat locking contact surface parallel to the contact surface of the trigger and normally out of engagement therewith, and adapted to be wedge-locked thereto upon straight line motion of the locking member.

5. The combination claimed in claim 4 wherein:

(a) each of the contact surfaces of the respective trigger and locking member defining a high friction surface.

6. The combination claimed in claim 5 wherein:

(a) each of the high friction surfaces formed of a material of substantially equal hardness.

7. The combination claimed in claim 5 wherein:

(a) one of the high friction surfaces formed of a relatively hard material, and (b) the other of the high friction surfaces formed of a material having a lesser hardness and more resiliency.

8. The combination claimed in claim 7 wherein:

(a) the locking member having a contact surface of less hardness and more resiliency then that of the trigger contact surface.

9. The combination claimed in claim 4 having a trigger switch controlling the speed of the motor responsive to the extent of the trigger depression wherein:

(a) the contact surface of the trigger of greater length then the contact surface of the locking member.

10. The combination claimed in claim 9 wherein:

(a) the contact surface of the trigger at least twice as long as the contact surface of the locking member.

11. The combination claimed in claim 3 wherein:

(a) a circuit board carrying a printed circuit and interconnected electrical components thereon is disposed in the handle, (b) the tapered bracket affixed to the circuit board, (c) the trigger slidably disposed in the tapered bracket, (d) the locking member slidably disposed in the tapered bracket whereby motion of the locking member will force it downwardly into contact with the trigger.

12. The combination claimed in claim 11 wherein:

(a) the lever of the locking member exits from the forward portion of the handle the resilient means defines a spring, (b) the spring is connected between the tapered bracket and the locking member to urge the locking member rearwardly into the handle in unlocked position out of contact with the trigger.

13. The combination claimed in claim 11 wherein:

(a) the lever of the locking member exits the rear portion of the handle, (b) the resilient means defines a spring, (c) the spring is disposed between the locking member and the housing to bias the locking member out of contact with the trigger toward the rearward portion of the handle.

14. A speed control switch mounted in the handle of a drill housing for controlling the speed of a motor of a drill comprising:

(a) a circuit board carrying a printed circuit in circuit with a series connected armature and field windings of the motor, (b) a control circuit operatively connected on the circuit board in circuit with the printed circuit, and including a silicon controlled rectifier, variable resistor and a capacitor to control the motor speed below line current, (c) a shunt line included in the printed circuits for selectively bypassing the control circuit, (d) a pair of mounting brackets affixed to the circuit board, (e) a plurality of terminals formed on the mounting bracket side of the circuit board to be connected in selective pairs to successively operate the control circuit and the shunt line, (f) a trigger slidably disposed in the mounting brackets to be normally biased outwardly of the handle, (g) a recess formed in the trigger on the side thereof facing the terminals, (h) a switch plate disposed in the trigger recess yieldably biased toward the circuit board and out of contact with the terminals when the switch is in the extended outward position, and on depression of the trigger to successively place the pairs of terminals in circuit to operate the motor at increasing speeds, (i) a locking member slidably connected to one of the mounting brackets and shiftable into contact with the trigger to lock the trigger in depressed position, (j) a resilient means connected to the locking member to normally urge the locking member away from the trigger and in the locked position to release the locking member from trigger engagement upon depressed motion of the trigger subsequent to locking.

15. The combination claimed in claim 14 wherein:

(a) a tapered section formed on one of the mounting brackets in spaced relation to the trigger, (b) the trigger having a contact surface adjacent the tapered section, (c) a tapered surface formed on the locking member in contact with the tapered section, (d) the resilient means defining a spring member engaging the locking member to urge the same away from contact with the trigger, (e) a high friction surface formed on the locking member in superposition to the contact surface of the trigger whereby on shifting of the locking lever the tapered surface of the lever to ride downwardly toward the trigger causing a wedge-lock between the friction surface and contact surface, which wedge-lock is releaseable upon depression of the trigger causing the tapered surface to rise away from engagement with the contact surface of the trigger via urging from the spring.

16. The combination claimed in claim 15 wherein:

(a) a reversing switch affixed to the circuit board and connected in series with the printed circuit, (b) an actuator for the reversing switch interlocked with the trigger in one of two positions switchable when the trigger is fully extended, and prevented from motion upon depression of the trigger.

17. The combination claimed in claim 14 wherein:

(a) the handle of the drill housing has a support portion and a cover portion.

(b) the circuit board is connected to the support portion of the handle whereby it will be entrapped therein upon the cover portion being joined to the support portion.

* * * * *